United States Patent [19]

Beard et al.

[11] Patent Number: 4,628,948

[45] Date of Patent: Dec. 16, 1986

[54] SYSTEM, APPARATUS, AND METHOD FOR PREPARING A QUANTITY OF TOBACCO FOR PRIMARY PROCESSING

[75] Inventors: Hoyt S. Beard, Winston-Salem; Marvin G. Woempner, Thomasville, both of N.C.

[73] Assignee: R. J. Reynolds Tobacco Company, Winston-Salem, N.C.

[21] Appl. No.: 482,394

[22] Filed: Apr. 6, 1983

[51] Int. Cl.[4] ..... A24B 3/06; A24B 3/16; A24B 5/14

[52] U.S. Cl. ..... 131/327; 131/303; 131/304; 131/300; 131/302; 131/306; 131/290

[58] Field of Search ..... 131/303, 304, 300, 302, 131/306, 307, 311, 327, 290

[56] References Cited

FOREIGN PATENT DOCUMENTS

| | | | |
|---|---|---|---|
| 1027577 | 4/1958 | Fed. Rep. of Germany | 131/327 |
| 1068599 | 11/1959 | Fed. Rep. of Germany | 131/327 |
| 2062203 | 5/1981 | United Kingdom | 131/303 |
| 156083 | 3/1963 | U.S.S.R. . | |

OTHER PUBLICATIONS

"Push-Button Cigarette Factory in Malmö", Tobacco; 6/30/67; staff writer, pp. 14–16.

*Primary Examiner*—V. Millin
*Assistant Examiner*—Gregory Beaucage
*Attorney, Agent, or Firm*—Jones, Tullar & Cooper

[57] ABSTRACT

A system, apparatus and method is proposed according to which a tobacco mass is proportioned for primary processing. The system and method provide for a controlled selection handling and proportioning of the tobacco mass, and for conditioning of the tobacco mass before further primary processing. The apparatus provides for conditioning an entire tobacco mass or for selected proportioning of the tobacco mass into smaller predetermined portions prior to conditioning. The system and method allow for blending different types of tobacco masses while utilizing the proportioning apparatus on selected tobacco masses.

21 Claims, 6 Drawing Figures

SYSTEM, APPARATUS, AND METHOD FOR PREPARING A QUANTITY OF TOBACCO FOR PRIMARY PROCESSING

CROSS-REFERENCE TO RELATED APPLICATION

The following specification contains subject matter related to the subject matter disclosed in commonly assigned co-pending application, Ser. No. 252,989, filed Apr. 4, 1981, by H. S. Beard et al, for APPARATUS FOR MOISTURE AND HEAT CONDITIONING COMPACTED TOBACCO MASS, now U.S. Pat. No. 4,383,538.

BACKGROUND OF THE INVENTION

1. Field of the Invention

The present invention relates to the preparation of a quantity of tobacco for primary processing, and in particular to a system, apparatus, and a method for preparing a quantity of tobacco for primary processing.

Primary processing refers to the overall process leading to product manufacture from tobacco which has been stored for aging. One feature of primary processing is conditioning of the tobacco, i.e., the moisture replenishment of the tobacco.

2. Prior Art

Various ways of conditioning tobacco are disclosed in the above-noted co-pending application. These range from a vacuum chamber to single and multiple probes. In each instance, the entire tobacco mass as it is received from storage is conditioned.

An alternate method is also discussed in the noted co-pending application according to which the tobacco mass is first broken into smaller pieces and then fed into a revolving steam drum. Variations of this method are disclosed in U.S. Pat. No. 2,767,717 and 3,494,367.

One of the drawbacks of conditioning the entire tobacco mass in a chamber is cost. One of the drawbacks encountered with probes is also cost as well as maintenance because the probes are susceptible to breakage. A drawback of those methods which employ breaking of the tobacco mass into smaller pieces is waste because of the particulate scrap or fines produced.

The noted copending application discloses an advance over the noted state-of-the-art in that it teaches flexibly securing the probe to a mounting plate so that the probe can flex within a given cone angle. Here too the entire tobacco mass is subjected to conditioning by the probes.

It would be desirable to enhance the design advance represented by the invention disclosed in the noted copending application while continuing to avoid the problem which would result from breaking the tobacco mass into smaller pieces, by altering the size of the tobacco mass being conditioned.

Another feature in the primary rocessing of tobacco, when more than one type of tobacco is being processed, is mixing of the different types of tobacco. Typically, this is done at the fiber level and not at the larger mass level. See, for example, U.S. Pat. No. 3,577,599.

It would also be desirable to improve the mixing aspect of primary processing at the larger mass level where less precision and control are acceptable.

OBJECTS AND SUMMARY OF THE INVENTION

It is an object of the present invention to provide an apparatus for proportioning a tobacco mass into smaller masses.

Another object of the present invention is to improve the process of conditioning tobacco as a result of the proportioning apparatus noted in the prior stated object.

Another object of the present invention is to modify the procedure for mixing different tobacco types utilizing a selection process of various sizes of tobacco masses prior to conditioning.

Another object of the present invention is to provide a system for preparing a quantity of tobacco for primary processing with a view toward improved conditioning of the tobacco and proportioning of the tobacco mass into smaller masses.

Another object of the present invention is to provide a method of forming a quantity of tobacco for primary processing with a view toward improved conditioning of the tobacco and proportioning of the mass into smaller masses.

Another object of the present invention is to improve the handling of different types of tobacco in the form of bales, hogsheads and offshore boxes in a controlled manner for primary processing.

Another object of the present invention is to achieve the previously stated objects with a unique arrangement of apparatus forming a controlled system.

The invention comprises a system, apparatus and method aspect with controlled selection, handling and proportioning of the different types of tobacco masses prior to conditioning thereof. Subsequent to conditioning of the tobacco it is subjected to further primary processing including well known procedures resulting in a final product. The system broadly includes two basic stations: a receiving station and a proportioning station. A weighing station and a conditioning station are preferably also employed. A conveyor network interconnects the various stations, and all activity is computer controlled.

The type of tobacco and the amount thereof are selected in accordance with a recipe for a desired blend. The recipe is entered into a computer, which controls the operation of the various conveyors of the conveyor network as well as the equipment at the various stations. At a central location, which is preferably located in close proximity to the system, an operator with access to the computer and to the tobacco masses being conveyed to the proportioning station removes the tags from the tobacco mass bearing the grade of the tobacco mass and enters this data into the computer. At the proportioning station a choice is made by the computer with the data stored in the computer as to what proportion of the the tobacco mass at the proportioning station is to be used consistent with the recipe. The desired portion is advanced to the conditioning station, while any remaining portion, or remnant is returned to the receiving station after being re-tagged by the operator. The process of selection, proportioning and conditioning continues until the recipe is satisfied.

BRIEF DESCRIPTION OF THE DRAWINGS

Six figures have been selected to illustrate the preferred embodiment of the invention. These figures, while schematic in nature, are sufficiently detailed to inform those skilled in the art. Included are.

DETAILED DESCRIPTION OF A PREFERRED EMBODIMENT

For ease of shippihg and storing, tobacco leaves are gathered into large masses which are known as bales, hogsheads and offshore boxes. Within a given tobacco mass the tobacco leaf particles are preferably packed with their broad face horizontally. The weight of a typical bale and hogshead is approximately 1,000 lbs. while that of a typical offshore box is approximately 440 lbs. An offshore box is a designation given to an imported tobacco. The bales, hogsheads and offshore boxes are tagged and placed in storage until needed for primary processing. The tags identify the weight, grade and belt (region of the country or foreign country from which the tobacco originates) of the tobacco.

Quite frequently, tobacco as a final product comprises a blend of at least two different types of tobacco. Since a given bale, hogshead or offshore box contains only tobacco of a given type, the desired blend or mixture of the final product must derive from more than a single bale, hogshead or offshore box.

Figure 1:
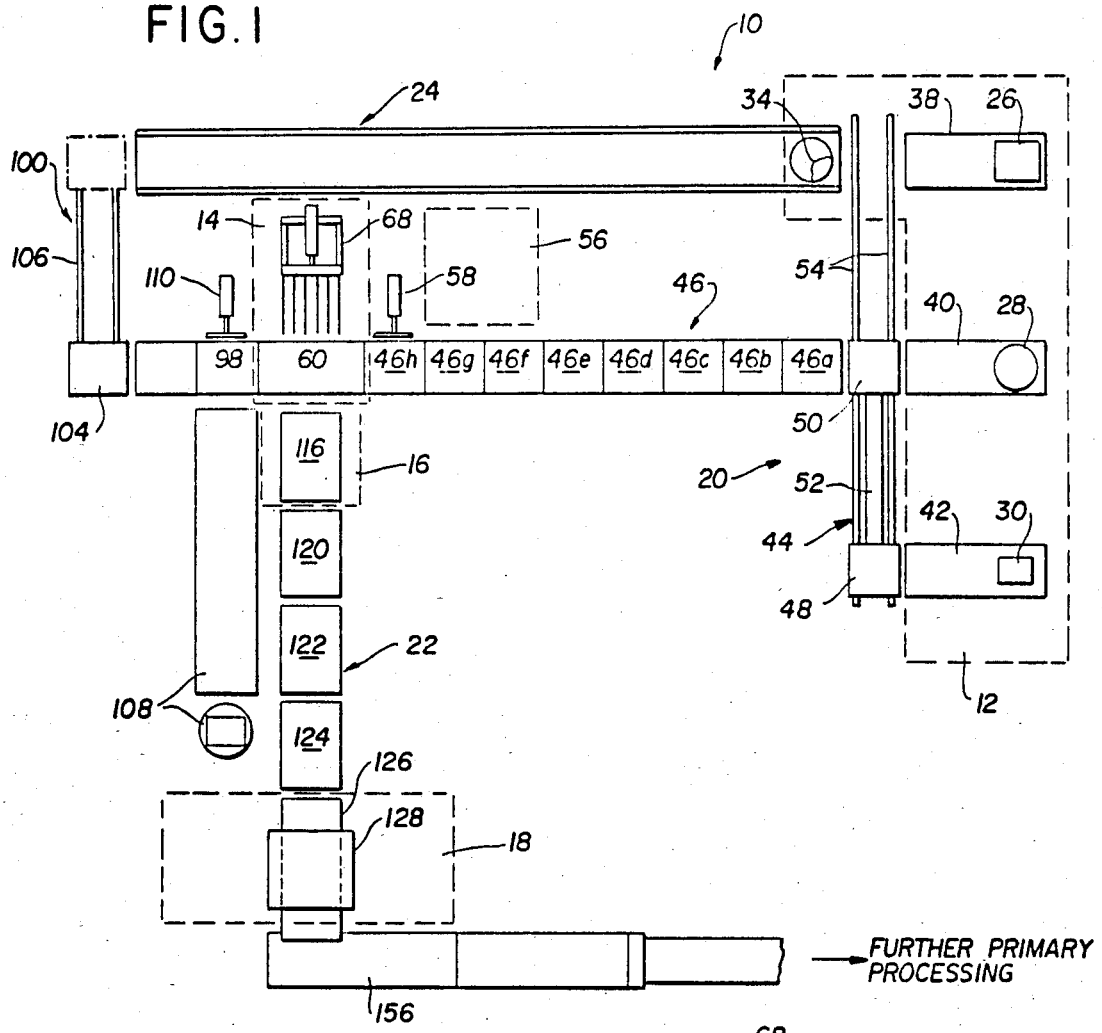
FIG. 1, which is a plan view of the system according to the present invention illustrating four stations, three conveyor lines and their interrelationship with the stations.

Turning now to FIG. 1, a system 10 for preparing a quantity of tobacco for further primary processing is shown, the system including conditioning which is one phase of primary processing. The system 10 preferably comprises four stations and three conveyor lines. These are: a receiving station 12; a proportioning station 14; a weighing station 16; and a conditioning station 18; interconnected by: a first conveyor line 20; a second conveyor line 22; and a third conveyor line 24. The first conveyor line 20 connects the receiving station 12 with the proportioning station 14, while the second conveyor line 22 connects the proportioning station 14 with the conditioning station 18, and the third conveyor line 24 connects the proportioning station with the receiving station 12. According to the preferred embodiment of the present invention the weighing station 16 is included in and made part of the second conveyor line 22.

At the receiving station 12 the different tobacco masses are situated ready for initial conditioning. The receiving station serves, therefore, as a point of origin for the different tobacco masses. A bale 26, a hogshead 28 and an offshore box 30 are shown, as well as a predetermined (remnant) portion 34 of a previously proportioned tobacco mass, such as a hogshead. The tobacco masses 26, 28 and 30, previously labeled or tagged when stored, are brought from holding inventory (not shown) to the receiving station 12 and placed on respective conveyors 38, 40 and 42. The label or tag identifies the grade of the tobacco. The remnant portion 34 is located at the end of the third conveyor line 24. The offshore box 30 is placed on, for example, a plywood head 36 (FIGS. 2 and 3) before it is placed on the conveyor 42. The bale 26 and hogshead 28 already are on respective heads 36, as is the remnant portion 34.

The first conveyor line 20 includes a shuttle car system 44 and a series of feed forward roller bed conveyor sections 46. The shuttle car system 44 comprises two roller bed cars 48 and 50 connected by a frame 52. The roller bed cars 48 and 50 run on tracks 54 between conveyors 38, 40 and 42. When car 50 is aligned with conveyor 38, it is also positioned to receive any remnant portion 34 from the third conveyor line 24. The spacing between the individual roller bed cars 48 and 50 is identical to the spacing between the conveyors 38, 40 and 42. Accordingly, the shuttle car system 44 can accomodate two tobacco masses at any given time. This feature is advantageous since it permits simultaneous transfer of one tobacco mass from conveyor 40 to the feed forward roller bed conveyor sections 46 while receiving another tobacco mass from either the third conveyor line 24, the conveyor 38 or the conveyor 42.

The series of feed forward roller bed conveyor sections 46 comprise any desired number of individual conveyor sections, for example conveyor sections 46*a*–46*h*. The movement of each conveyor section 46*a*–46*h* is individually controlled as is the movement of the shuttle car system 44 and the conveyors 38, 40 and 42. Preferably, the movement of each is monitored by a photocell and controlled from a central control location 56 where all local controls and an operator are located. Section 46*g* serves as a data entry section at which the tag on the tobacco mass is removed by the operator and the grade of the tobacco mass indicated on the tag is entered by the operator into a central master computer located remotely, for example, in a plant computer room. Subsequent to data entry, the tobacco mass is next moved to a holding position on the roller bed conveyor section 46*h*, where a hydraulically actuated pusher 58 assures that the tobacco mass is pushed or aligned fully to the opposite side of the roller bed conveyor section 46*h*. The alignment insures that the side surfaces of the tobacco mass (viewed in the direction of travel) are normal to the direction of travel of the proportioning apparatus at the proportioning station 14.

When the proportioning station 14 is ready to receive the next mass of tobacco, conveyor section 46*h* is activated to transfer the aligned tobacco mass to a conveyor section 60 located at the proportioning station 14. The conveyor section 60, comprises a belt conveyor serving as an extension of, and therefore a part of, the first conveyor line 20.

The belt conveyor 60 is mounted on an in-floor lift apparatus 62 (FIG. 2) which includes a hydraulic lift cylinder 64 carrying a platform 66 on which the belt conveyor section 60 is mounted. At the conveyor section 60 a tobacco mass 67, which may, for example, be a bale 26, a hogshead 28, an offshore box 30, or a previously used remnant is halted in alignment with conveyor line 22, and the mass is raised, if proportioning is desired, until a desired first predetermined portion of the mass becomes accessible to a proportioning apparatus 68.

The proportioning apparatus 68 includes a mounting frame 70 on which a carriage 72 and a hydraulic cylinder 74 are mounted. The carriage 72 rides on wheels 76 along a horizontal track 78, forming part of the mounting frame 70. A further carriage 80 is provided which rides on wheels 82 along a vertical track 84 forming part of the carriage 72. The carriage 72 is displaced horizontally along the track 78 by the hydraulic cylinder 74, while the carriage 80 is displaced vertically along the track 84 by a hydraulic cylinder 86 which is mounted on the carriage 72.

Carriage 80 supports severing prongs, or tines, 88, while prongs 90 are supported by the carriage 72. Accordingly, the prongs 88 are displaceable both horizontally and vertically, while the prongs 90 are displaceable only horizontally. The prongs 88 and 90 are preferably made of fork lift steel and tapered for ease of severing or cutting tobacco masses during proportioning. Moreover, the prongs 88 and 90 are staggered and interleaved relative to each other such that when the carriage 80 is in its lower position the prongs 88 and 90 lie in the same plane.

A hydraulic cylinder 92 is also mounted to the carriage 80, and a pusher plate 94 is mounted to the movable rod 95 of the hydraulic cylinder 92. The pusher 94 engages separated upper portions of the tobacco mass and moves them onto conveyor line 22 and the weighing station 16.

Figure 2:
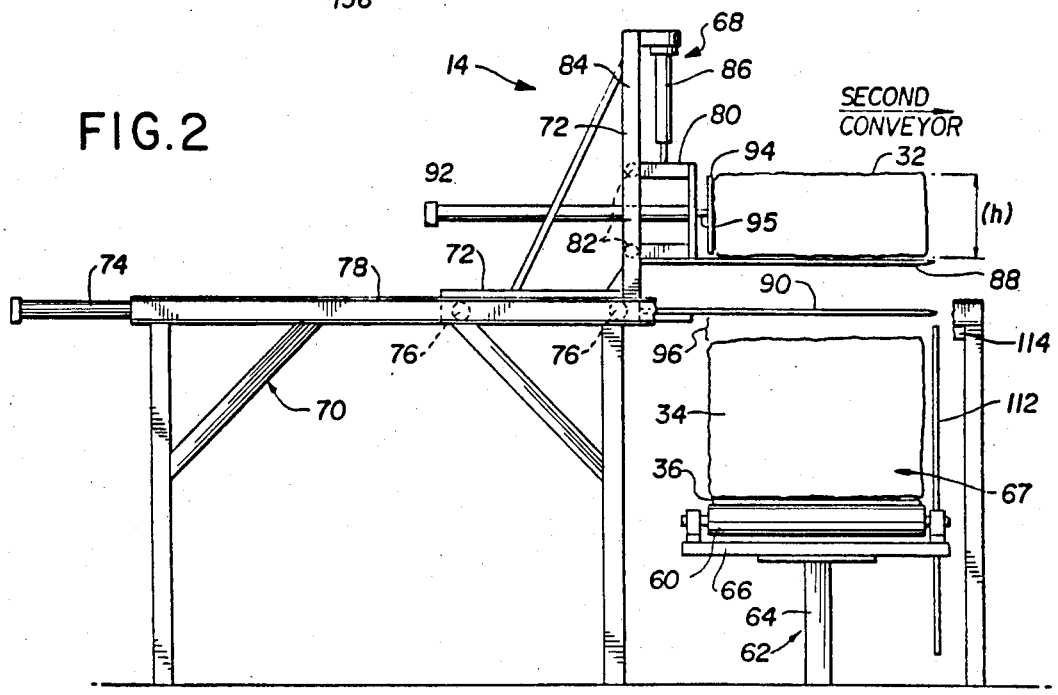
FIG. 2, which is an elevational view of the proportioning station illustrating details of the proportioning apparatus and a lifting apparatus.
Figure 3:
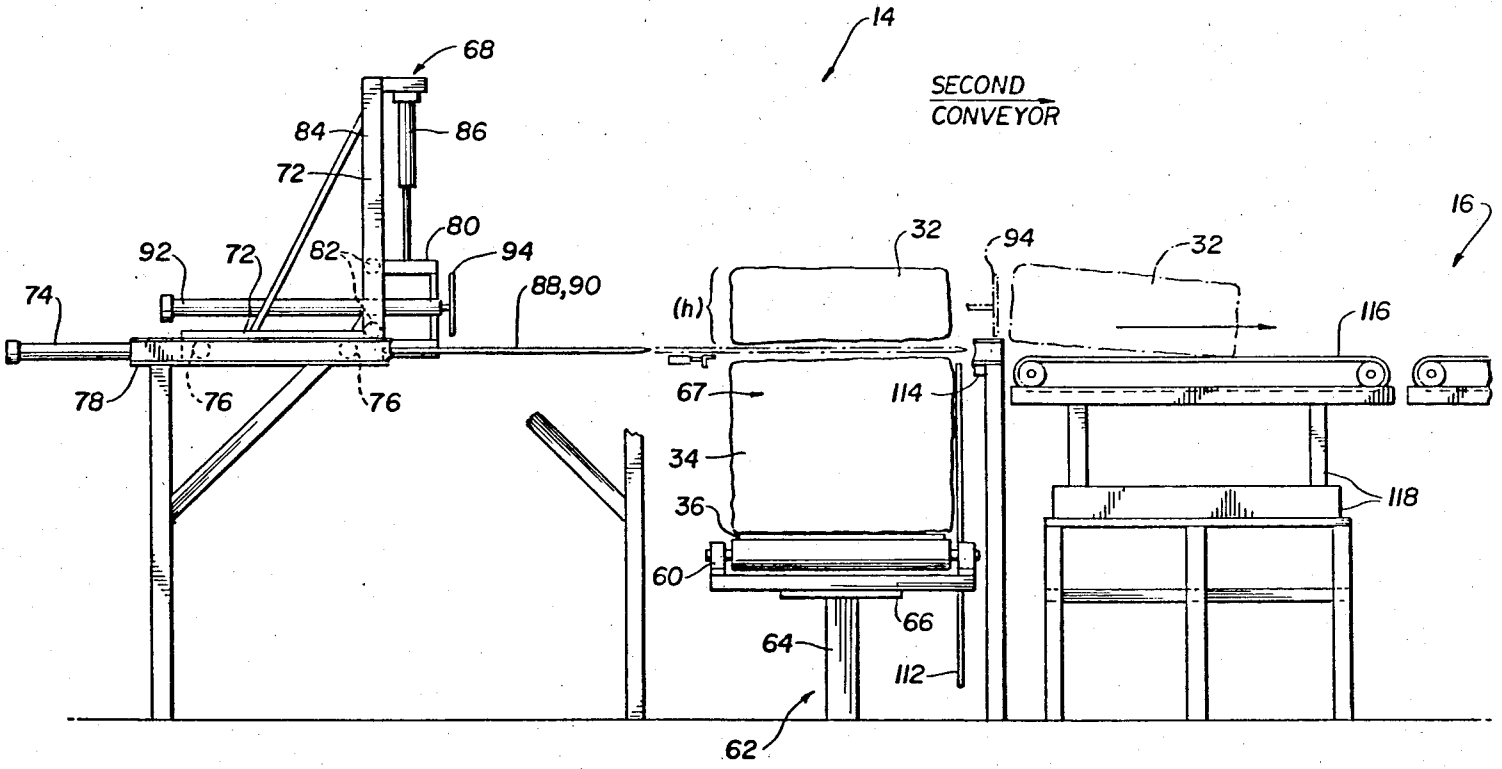
FIG. 3, which is an elevational view of the proportioning station illustrating, in dashed lines, delivery of a predetermined portion of a tobacco mass to the weighing station situated in the second conveyor line.

As previously noted, the tobacco mass 67 is advanced to a conveyor section 60, which is raised to the desired level so that a predetermined portion is accessible to the proportioning apparatus 68. The hydraulic cylinder is then actuated to displace the carriage 72 horizontally and to the right as shown in FIGS. 2 and 3. During this movement the carriage 72 moves from the position shown in solid lines in FIG. 3 to the position shown in dotted lines in the same figure, so that the prongs 88 and 90 are displaced to pentetrate and extend completely through the tobacco mass. Next the hydraulic cylinder 86 is actuated, causing the carriage 89 to be drawn upwardly toward the position shown in FIG. 2. This upward movement of the carriage 80 produces a relative vertical displacement of the prongs 88 and 90, thereby separating the tobacco mass 67, forming a first severed portion 32 and a remnant portion 34. The lift apparatus 62 is then lowered slightly, as shown in FIG. 2, creating clearance 96 and sepatating the upper portion from the remnant portion. This permits the carriage 80 to be lowered by the hydraulic actuator 86 to its initial position where the hydraulic actuator 92 then causes the pusher 94 to be displaced horizontally and to the right, as shown in dotted lines in FIG. 3, to move the first severed portion 32 to the weighing station 16.

After weighing the portion 32 delivered to the weigh station 16, the central computer determines whether additional tobacco is required from mass 67 for the particular recipe being blended, and if so the proportioning described above is repeated, and a second portion 32 of tobacco is severed from mass 67. When a sufficient weight of tobacco has been supplied to conveyor line 22 from the particular mass 67, the remnant portion 34 is lowered by the lift apparatus 62 and moved from the conveyor section 60 onto a recycling conveyor section 98 (FIG. 1). From the conveyor section 98 the remnant portion 34 is taken by a shuttle 100 to a return conveyor 102 and returned to the transfer station 12. Both the shuttle 100 and the conveyor 102 form part of the third conveyor line 24. The shuttle 100 includes a roller bed car 104 which runs on tracks 106 between the conveyor section 98 and the conveyer line 102.

In those instances when the entire mass 67 is delivered, either without proportioning or by successive proportioning, to the conditioning station 18, all that is delivered to the conveyor section 98 is the plywood head 36. When this occurs, the plywood head is delivered to a sorting/stacking apparatus 108 rather than to the third conveyor line 24. For this purpose, a hydraulically actuated pusher 110 is provided adjacent to the conveyor section 98. In order to prevent the head 36 from being delivered to the conveyor line 22, the hydraulic lift cylinder 64 is limited to prevent the conveyor from carrying the head 36 to or above the level of the prongs 90. Further, suitable head board clamps (not shown) may be mounted on the frame 70 for motion into engagement with the side edges of the head 36 to hold it on the conveyor 60 during a severing operation.

As a precaution against tilting of the tobacco mass during penetration by the prongs 88 and 90, a backboard 112 is provided at the conveyor section 60. A safety device to prevent damage to the prongs 90 is provided in the form of a limit switch 114 mounted on the frame structure 70 below the plane of advancement of the prongs 90. The limit switch 114, which may comprise a photocell, provides a signal indicating the arrival of the plywood head 36 and thus indicates that the particular tobacco mass on the conveyor section 60 is near exhaustion. Alternatively, the limit switch 114 can be situated in the hydraulic lift cylinder 64 and be actuated when the cylinder 64 reaches the full up position. The signal from the limit switch 114 may also be used to activate the head board clamps to prevent the head from being delivered to conveyors 22.

If more tobacco of the kind represented by the nearly exhausted tobacco mass is needed beyond the quantity remaining therein, then a new tobacco mass of the same type must be delivered to the proportioning apparatus 68 from the receiving station 12. However, it is not necessary that the next tobacco mass in the sequence supplied from conveyor line 20 be of the same type, for the central computer keeps a running record of the weight of tobacco of each particular type or grade which has been supplied to conveyor 22, subtracts that weight from the weight required by the recipe for the batch being conditioned, and provides necessary control output signals to the equipment at the proportioning station. The computer selects among the tobacco masses being fed forward randomly along the conveyor 46 to fill out the recipe. In this regard, previously proportioned tobacco masses, i.e., remnant tobacco portions 34, stored on the third conveyor line 24 may be recirculated to the proportioning station by the shuttle car system 44. These remnants preferably are supplied first to the feed roller bed sections 46 of the first conveyor line 20 in order to meet the recipe requirements of the next lot of tobacco to be blended.

In proportioning the tobacco masses 26, 28, 30 at station 14 it has been determined that optimized maximum and minimum portions, from both a weight and conditioning standpoint, are those which have a height (h) of approximately 18 inches (maximum) and 9 inches (minimum). Therefore, if a proportioned quantity of a particular tobacco mass for a given recipe is desired, which by weight would exceed the portion represented by the first severed portion 32, additional portions of not more than approximately 18 inches in height and not less than approximately 9 inches in height are formed until the desired quantity is reached. To control the height (h), photocells (not shown) are located at the 9 inch and 18 inch level (FIG. 3). These photocells are used in conjunction with the computer to control the travel of the hydraulic lift cylinder 64.

Figure 4:
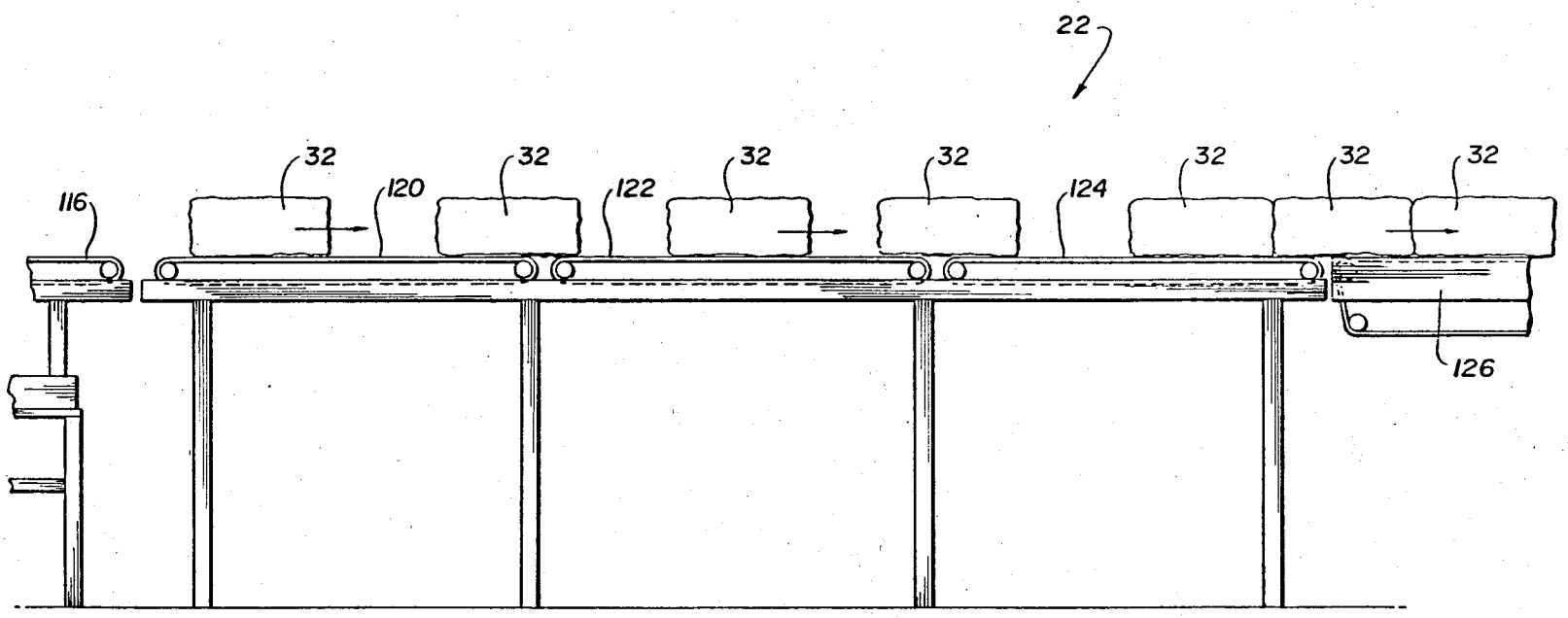
FIG. 4, which is an elevational view of the second conveyor line between the weighing station and the conditioning station.
Figure 5:
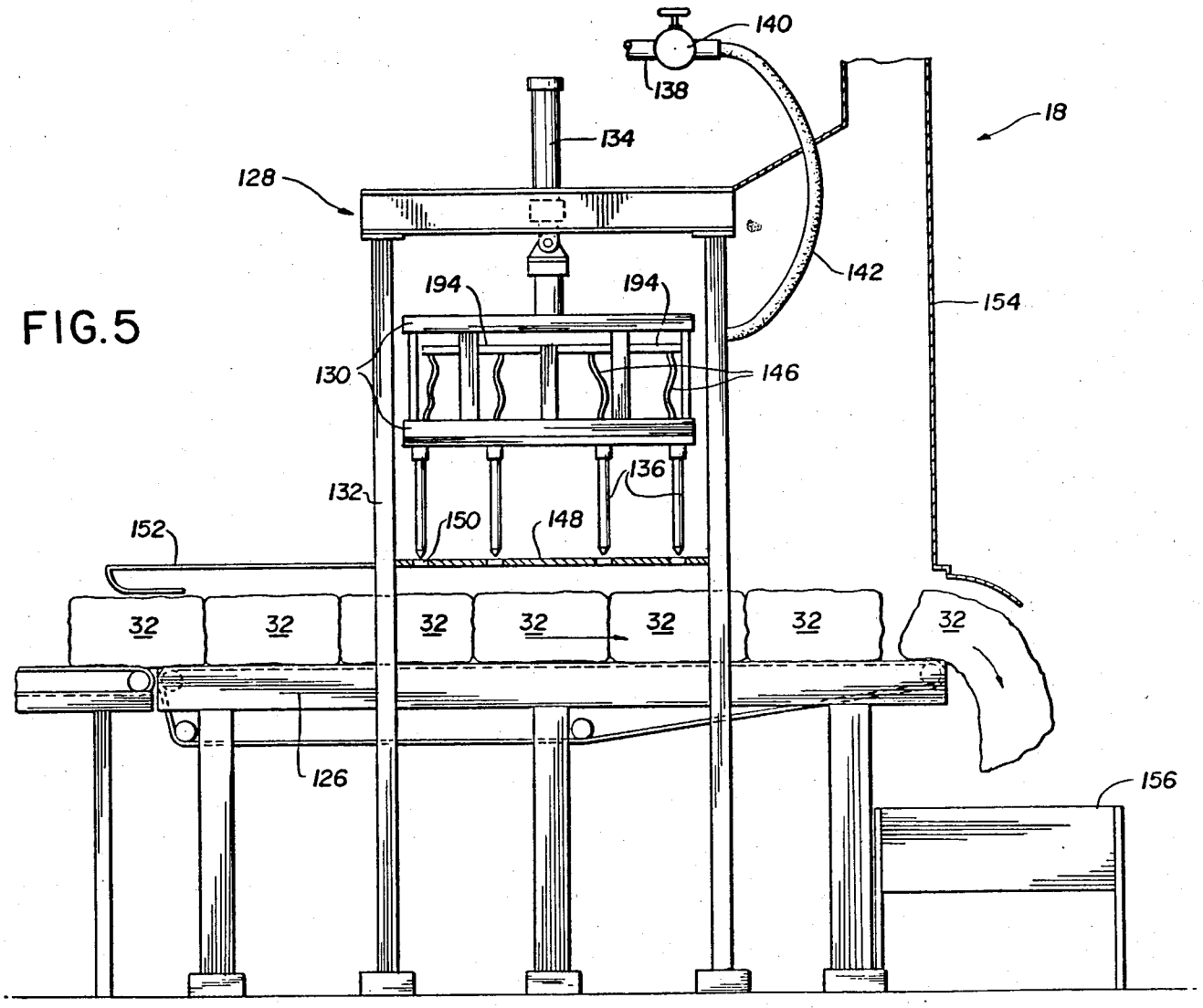
FIG. 5, which illustrates details of the conditioning station.

The weighing station 16 (FIG. 3) comprises a conveyor section 116 mounted on a weigh frame 118 which registers the weight of the first severed portion 32 and transmits that value to the central computer. After the weighing step has been completed, conveyor section 116 supplies successive severed portions 32 to the remaining conveyor sections 120, 122 and 124 which make up the second conveyor line 22 (FIG. 4). These sections speed up the successive severed portions 32 so that later portions catch up to prior portions so as to form a continuous stream, the speed of the successive conveyor sections 120, 122 and 124 are controlled using photocells (not shown) for monitoring the location of successive severed portions in conjunction with the computer. The continuous stream at the conditioning station 18 is desired so that a continuous mass of tobacco is presented to the conditioning apparatus 128 (FIG. 5). Alternatively, if desired, the portions 32 may, by an alternate arrangement of the photocells, be caused to remain separated and thus be fed to the conditioning station as separate masses.

The conditioning apparatus 128 includes a carriage 130 guided for vertical displacement along tracks 132 by a hydraulic cylinder 134. Extending downwardly from the carriage 130 are probes 136. The shape of the probes 136, the size of their orifices, their mounting method to the carriage 130 are similar to that described in the previously noted copending application, except that the probes 136 are preferably made of Chrome-Molybdenum steel, are ⅝ inches in diameter and are 30 inches long. Steam is supplied to the probes through a main line 138, a throttling valve 140, a hose 142, a manifold 144 and individual hoses 146. The probes are arranged in a staggered pattern on 5 inch centers as described in the noted co-pending application. By means of the valve 140, low pressure steam is turned on to assist in penetrating the tobacco masses; then high pressure is turned on for a dwell period during which time the probes 136 are in the tobacco mass. The steam pressures and flows are similar to those disclosed in the noted copending application. When the probes 136 are withdrawn from the tobacco masses, the tobacco masses are stripped off by a stripper board 148 which has holes 150 therein to accommodate the probes 136. Hoods 152 and 154 are provided to exhaust excess steam, and the conditioned tobacco masses 32 are fed into subsequent handling equipment 156 (feeder, cylinder, etc.) where the blend in accordance with the recipe is further processed.

Structural details of the various conveyor lines and sections, as well as the various hydraulic actuator cylinders have not been discussed as they are conventional and not necessary to an understanding of the invention. The connections of the various hydraulic lines to the hydraulic cylinders and electrical lines from the photocells to the central control location and from the central control location to the various conveyor drives have not been shown as they too are conventional and not necessary to an understanding of the invention.

As to the overall system control, it is desirable to have an operator at the central control location 56, adjacent to the data entry section **46*g* for manning the computer and overseeing the various hydraulic and electrical control functions. The operator first enters the recipe into the central master computer, such as an HP 3000 computer, and initiates delivery of a tobacco mass 26, 28 and 30 to the data entry section 46*g*. When the particular tobacco mass reaches the data entry section 46*g*, the operator removes the tag attached thereto and enters the data thereon (tobacco grade) into the computer. The computer compares the data input from the tag against the recipe and notes whether the recipe has been satisfied with respect to that grade of tobacco. If not, it adjusts the proportioning apparatus so that the proper quantity of tobacco of the given type now at the proportioning station 14 is proportioned. If less than the entire amount of tobacco in the tobacco mass is required, a remnant portion is generated and returned to the receiving station via the third conveyor line 24. When the remnant portion reaches the central control location 56 on the conveyor 102, the operator re-applies the tag identifying the tobacco grade. The quantity to be proportioned is proportioned as successive portions of preferably 18 inch height or less, but preferably not less than 9 inches, and advanced to the conditioning station 18. If the entire amount of tobacco in the tobacco mass is required, it too can be proportioned as successive portions of perferably 18 inch height or less, but preferably not less than 9 inches, or alternatively, the entire mass can be simply advanced to the conditioning station 18**.

Figure 6:
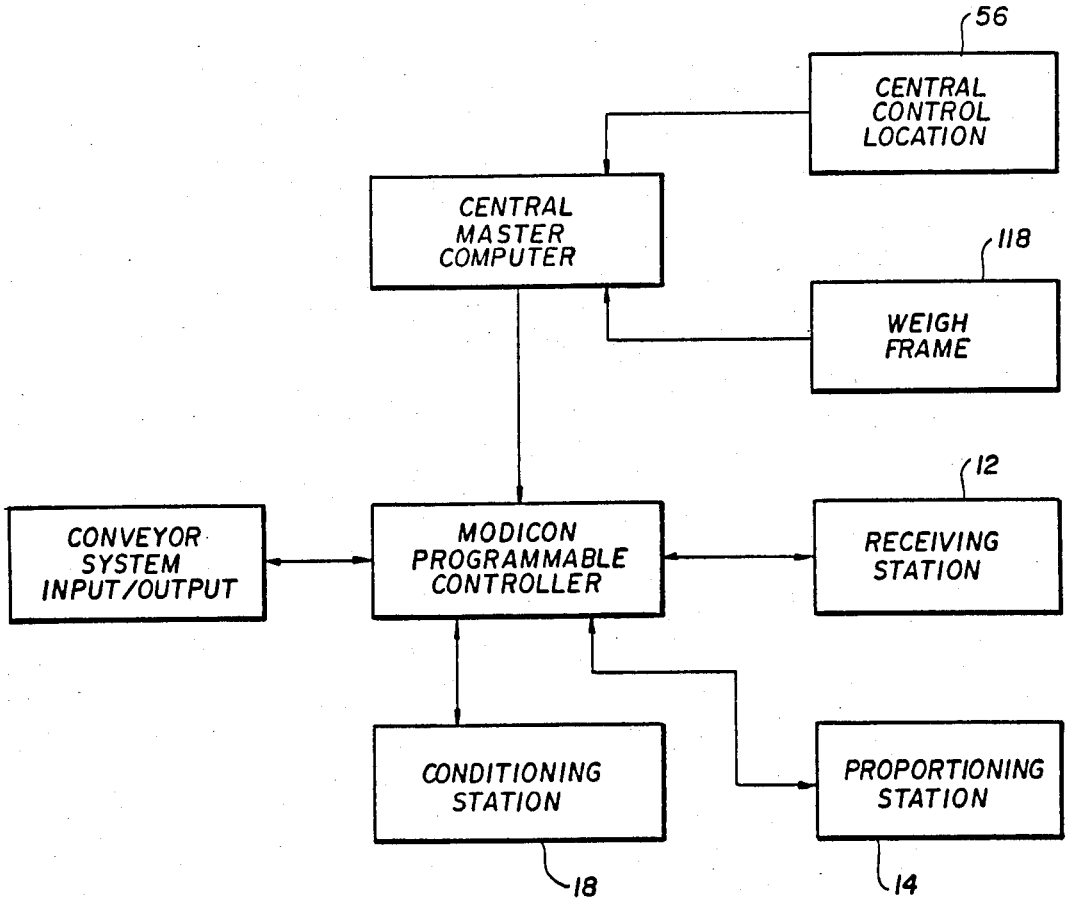
FIG. 6, which is a block diagram of a control circuit for the system shown in FIGS. 1–5.

Referring to FIG. 6, the operation described above can be easily visualized, as can the relationship of the various control components relative to the central master computer and its controller. For example, the input/output of the three conveyor systems refers to the signals received from and sent to the sensor controls, photocells for example, which are conventional and therefore not further shown, which control the operation of the drive mechanism, also not shown as it too is is conventional, of these conveyor systems.

With the system, apparatus and method of the present invention, a tobacco mass is prepared for primary processing in a more accurate, rapid and less costly manner. The tobacco mass is more effectively conditioned due to the fact that the improved probe method of the copending application is used. This is one result of proportioning a larger tobacco mass into smaller tobacco masses. Proportioning also has the effect of enhancing blending and therefore mixing of tobacco during primary processing.

We claim:

1. A system for preparing a quantity of tobacco for further primary processing, comprising:

a receiving station for storing tobacco masses for the system;

a proportioning station for proportioning from a tobacco mass received from the receiving station at least one predetermined portion for conditioning and a remant portion for return to the receiving station, and for advancing tobacco masses, predetermined portions and remnant portion received from the receiving station toward a conditioning station;

a conditioning station for applying conditioning fluid to those tobacco masses, predetermined portions and remnant portions advanced thereto from the proportioning station;

first conveyor means for conveying tobacco masses and remnant portions from the receiving station to the proportioning station;

second conveyor means for conveying those tobacco masses, predetermined portions and remnant portions for conditioning from the proportioning station to the conditioning station;

third conveyor means for conveying remant portions from the proportioning station to the receiving station; and central control means for controlling the operation of each conveyor means and the operation of each station.

2. The system of claim 1, wherein:

a plurality of different grade types of tobacco masses are stored at the receiving station;

the first conveyor means includes means for selecting one of said plurality of different grade types of tobacco masses at the receiving station for preparation, and said plurality of different grade types of tobacco masses including remnant portions of previously selected tobbaco masses.

3. The system of claim 2, wherein:

the receiving station includes spaced apart locations for each different grade type of tobacco mass;

the first conveyor means further includes a conveyor; and said means for selecting comprises shuttle means controlled by said central control means and displaceable relative to the conveyor and between said locations for receiving at least one tobacco mass for transport to the conveyor.

4. The system of claim 3, wherein:

the shuttle means is adapted to receive two tobacco masses of different grade type simultaneously for transport, in seriatim, to the conveyor.

5. The system of claim 4, wherein:

the conveyor includes a plurality of individually controlled conveyor sections controlled by said central control means.

6. The system of claim 5, wherein:

one of said individually controlled conveyor sections includes adjustment means for adjusting the position of the tobacco masses relative to the proportioning station.

7. The system of claim 6, wherein:

said adjustment means includes a hydraulically actuated cylinder controlled by said central control means.

8. The system of claim 6, wherein:

the proportioning station includes: proportioning means; actuating means for displacing the proportioning means toward a tobacco mass located on said conveyor section adjacent to the proportioning station, said proportioning means proportioning from a tobacco mass said at least one predetermined portion for conditioning and said remnant portions; and advancing means for advancing tobacco masses, predetermined portions and remnant portions to the second conveyor means.

9. The system of claim 8, wherein:

the actuating means and the advancing means each include hydraulically actuated cylinder means controlled by said central control means.

10. The system of claim 9, wherein:

the proportioning means includes a carriage and two sets of prongs mounted in interleaved fashion to the carriage and extending outwardly therefrom; and the actuating means includes two hydraulically actuated cylinders, one for displacing the carriage, and with it the two sets of prongs, so that the two sets of prongs extend through the tobacco mass located on said conveyor section adjacent the proportioning station, and the other for separating the two sets of prongs relative to each other and into different parallel planes.

11. The system of claim 10, wherein:

the advancing means includes a hydraulically actuated cylinder mounted to the carriage.

12. The system of claim 10, further comprising alignment means for aligning a tobacco mass on a conveyor section upstream of the proportioning station so that the tobacco mass defines an outer surface normal to the direction of displacement of the two sets of prongs toward the tobacco mass.

13. The system of claim 12, wherein:

the alignment means includes a hydraulically actuated cylinder controlled by said central control means.

14. The system of claim 1, wherein:

the second conveyor means comprises a conveyor including a plurality of individually controlled conveyor sections controlled by said central control means, one of said conveyor sections including weighing means for weighing those tobacco masses, predetermined portions and remnant portions advanced toward the conditioning station.

15. The system of claim 1, wherein:

the third conveyor means comprises an accumulating conveyor serving as part of said receiving station, and shuttle means displaceable between the first conveyor means and the accumulating conveyor for transporting remnant portions not for conditioning from the first conveyor means to the accumulating conveyor; and the accumulating conveyor and the shuttle means are controlled by said central control means.

16. A method of forming a quantity of tobacco in accordance with a given recipe from tobacco masses for further primary processing, comprising the steps of:

storing tobacco masses at a point of origin;

proportioning certain selected tobacco masses into at least one predetermined portion in accordance with the receipe for conditioning and a remnant portion for return to the point of origin; and applying conditioning fluid to tobacco masses, predetermined portions and remnant portions.

17. The method of claim 16, further comprising the step of:

weighing the tobacco masses, the predetermined portions and remnant portions for conditioning prior to applying the conditioning fluid.

18. A method of forming a blend of tobacco for further primary processing in accordance with a given recipe and from at least two different grades types of tobacco, each different grade of tobacco being supplied as a tobacco mass, comprising the steps of:

storing at least two different grades types of tobacco masses at a point of origin;

selecting tobacco masses from those stored at the point of origin for primary processing;

proportioning certain selected tobacco masses into at least one predetermined portion for conditioning and a remnant portion for return to the point of origin; and applying conditioning fluid to tobacco masses predetermined portions, and remnant portions in accordance with the recipe.

19. The method of claim 18, further comprising the step of:

weighing the tobacco masses, predetermined portions, and remnant portions for conditioning prior to applying the conditioning fluid.

20. The method of claim 18, further comprising the step of:

returning remnant portions not for conditioning to the point of origin.

21. An apparatus for proportioning a tobacco mass into at least two predetermined smaller tobacco masses, comprising:

proportioning means;

support means for supporting a tobacco mass stationary relative to the proportioning means; and actuating means for displacing the proportioning means toward the support means for engaging the tobacco mass and proportioning the tobacco mass into two predetermined small portions, wherein:

the proportioning means includes a carriage and two sets of prongs mounted in interleaved fashion to the carriage and extending outwardly therefrom; and the actuating means includes two hydraulically actuated cylinders, one for displacing the carriage, and with it two sets of prongs, so that the two sets of prongs extend through the tobacco mass located on the support means, and the other for separating the two sets of prongs relative to each other and into two different parallel planes.

* * * * *